United States Patent [19]

Antonelli

[11] Patent Number: 4,561,956

[45] Date of Patent: Dec. 31, 1985

[54] APPARATUS FOR RINSING ELECTROPLATING SOLUTION FROM ARTICLES

[75] Inventor: Christopher C. Antonelli, Smithfield, R.I.

[73] Assignee: Antonelli Plating Co., Providence, R.I.

[21] Appl. No.: 615,451

[22] Filed: May 29, 1984

[51] Int. Cl.[4] ..... C25D 5/48; C25D 21/08

[52] U.S. Cl. ..... 204/232; 134/85; 134/88; 134/92; 204/237

[58] Field of Search ..... 134/10, 25.4, 34, 60, 134/85, 88, 89, 92, 26; 204/237, 238, 239

[56] References Cited

U.S. PATENT DOCUMENTS

| | | | |
|---|---|---|---|
| 486,756 | 11/1892 | Bradshaw | 134/92 X |
| 1,561,132 | 11/1925 | Wise | 134/92 |
| 2,665,698 | 1/1954 | Robinson | 134/88 |
| 3,734,108 | 5/1973 | Almegard et al. | 134/76 |
| 3,945,388 | 3/1976 | Clark | 134/60 X |
| 3,979,220 | 9/1976 | Ishiyama et al. | 134/10 |
| 4,192,331 | 3/1980 | Koering | 134/77 |
| 4,469,526 | 9/1984 | Budinsky et al. | 134/25.4 |

*Primary Examiner*—Marc L. Caroff

*Attorney, Agent, or Firm*—Salter & Michaelson

[57] ABSTRACT

A method and apparatus for rinsing electroplating solution from the surfaces of articles so that substantially complete recovery of the electroplating solution is achieved. The apparatus is preferably receivable on a wall of an electroplating tank and comprises an open housing-like structure having a splash wall and an open trough beneath the splash wall, and a rack for supporting at least one plated article in front of the splash wall above the trough. For use of the apparatus in accordance with the method, an article is supported on the rack in front of the splash wall, and a rinse solution, such as water, is sprayed onto the article in order to rinse electroplating solution from the surfaces thereof. The rinse solution and any plating solution intermixed therewith gravitate downwardly from the article and the splash wall and are received in the trough and then transferred to the plating tank.

4 Claims, 2 Drawing Figures

APPARATUS FOR RINSING ELECTROPLATING SOLUTION FROM ARTICLES

BACKGROUND AND SUMMARY OF THE INVENTION

The instant invention relates to electroplating and more particlarly to a method and apparatus for rinsing electroplating solutions from the surfaces of articles after the plating thereof.

Most of the heretofore-known electroplating solution systems have generally comprised a single plating tank and a series of "drag-out" or rinse tanks which are positioned adjacent the plating tank for receiving and rinsing articles in a predetermined rinse sequence after they have been plated. For use and operation of a system of this type, an article is immersed in a plating solution in the plating tank and electrically connected to one terminal of a DC power source, and the other terminal of the DC power source is electrically conected to an electrode which is also immersed in the plating solution. When the DC power source is energized, the article is electroplated in a conventional manner, and the extent of the plating is determined by process parameters, such as the current density which is applied by the DC power source, the concentration of the plating solution, and the duration of the plating process. Finally, after an article has been plated to the desired extent in this manner, it is removed from the plating tank and then sequentially immersed in the "drag-out" tanks in order to rinse any plating solution which is carried on the surfaces of the article.

It is obvious that as a result of solution carryover, if a system of the above type is operated without frequently changing the rinse solutions in the various rinse tanks, the concentration levels of electroplating solution in the rinse solutions will rapidly reach intolerable levels. Because environmental regulations prohibit the discharge of liquids containing high quantities of metallic electroplating solutions into sewage systems, and also because electroplating solutions are relatively expensive, it is not practical to discard the rinse solutions used in an electroplating solution system when the concentration levels of electroplating solution in these rinse solutions become too high. Accordingly, it has generally been the practice to transfer rinse solutions from tank to tank in a system in the reverse order of the sequence of the plating and rinse tanks so that the plating solution in the plating tank is replenished with rinse solution from the first rinse tank (plus some plating chemicals), the rinse solution in the first rinse tank is replenished with rinse solution from the second rinse tank and so on, the solution in the last rinse tank being replenished with water. The operation of a plating solution system in this manner assures that substantially all of the plating solution which is carried over into the various rinse tanks is recovered, and also the concentrations of the plating solution in the various rinse tanks are maintained at equilibrium levels which gradually decrease with each sequential rinse tank. Obviously, in order to effectively operate a system of this type, it is important that an electroplated article is rinsed in the various rinse tanks in the prescribed sequence in order to effectively rinse all of the plating solution from the surfaces of the article and also in order to assure that the concentrations of the plating solution in the various rinse tanks are maintained at equilibrium levels. However, while plating solution systems of this type have been found to be generally effective, they have normally required several rinse tanks in order to assure effective removal of all of the electroplating solution from the surfaces of articles; and hence solution systems of this type have been relatively expensive, and they have normally required large areas of floor space. Further, if the various tanks of a system of this type are not positioned directly adjacent one another in the proper sequence, substantial quantities of plating and/or one or more of the rinse solutions are normally dripped or spilled onto the floor as articles are transferred from tank to tank.

The instant invention provides a novel method and apparatus for rinsing electroplating solution from the surfaces of articles after the articles have been plated, and the method and apparatus of the instant invention effectively overcome many of the problems associated with the hertofore known electroplating methods and solution systems. The apparatus of the instant invention is operative for receiving articles for rinsing electroplating solution therefrom and comprises a splash wall having an outwardly facing surface thereon, means for supporting at least one plated article in front of the outwardly facing surface, and an upwardly facing trough which is positioned beneath the outwardly facing surface and the article support means for receiving rinse solution and electroplating solution intermixed therewith which gravitates downwardly after the rinse solution has been sprayed onto the article. In the preferred embodiment of the apparatus, the trough is integrally attached to the lower end of the splash wall and means is provided for suspending the splash wall, the article support means, and the trough from a wall of an electroplating tank so that the splash wall is disposed adjacent the outer surface of the tank wall. For use of the apparatus in accordance with the method of the instant invention, an article which has been electroplated is positioned on the article support means in front of the splash wall, rinse solution is sprayed onto the article to remove electroplating solution from the surfaces thereof, and the rinse solution and any plating solution intermixed therewith which gravitates downwardly from the article and the wall is collected in the trough and transferred into the plating tank. Accordingly, the article is effectively and completely rinsed with a minimal amount of rinse solution, and substantially all of the electroplating solution which is removed from the plating tank as a result of carryover is recovered and returned to the plating tank. Further, while preferably the method is carried out utilizing the apparatus of the instant invention, other forms of the method which are carried out with other types of apparatus are also contemplated. In this connection broadly, the method of the instant invention for rinsing electroplating solution from the surface of an article is defined by a series of steps comprising spraying the article with a rinse solution such as water to remove electroplating solution from the surfaces thereof, collecting the rinse solution and any electroplating solution intermixed therewith, and transferring the collected rinse solution with plating solution intermixed therewith to the plating tank. Hence it is seen that the preferred form of the method which is carried out with the apparatus of the invention and the more general form of the method of the instant invention provide a novel process whereby electroplating solution can be effectively rinsed from the surfaces of articles utilizing minimal quantities of rinse solution and whereby substantially all of the electroplating solution which is carried on the surfaces of articles when they are removed from an electroplating tank is recovered and returned to the electroplating tank.

Apparatus and methods which are exemplary of the closest prior art to the instant invention of which the applicant is aware are disclosed in the U.S. Patents to Ishisaka, U.S. Pat. No. 1,771,680; Robinson, U.S. Pat. No. 2,665,698; Dolan et al, U.S. Pat. No. 3,276,983; Latawiec et al; U.S. Pat. No. 3,287,238 and Koering, U.S. Pat. No. 4,192,331. The apparatus and methods disclosed in these references relate generally to the types of apparatus and methods which have been used for electroplating articles for many years. However, they fail to suggest an apparatus for receiving an article for rinsing electroplating solution therefrom by spraying a rinse solution onto the article as per the apparatus of the instant invention. They also fail to disclose a method for rinsing electroplating solution from the surfaces of an article by spraying a rinse solution onto the article; and accordingly, for these reasons all of the above references are believed to be of only general interest.

Accordingly, it is a primary object of the instant invention to provide an effective apparatus for receiving an article for spraying a rinse solution thereon after the article has been electroplated so that electroplating solution is rinsed from the surfaces of the article.

Another object of the instant invention is to provide an effective method for rinsing electroplating solution from the surfaces of an article after it has been electroplated.

A still further object of the instant invention is to provide an effective apparatus for rinsing electroplating solution from the surfaces of an article, wherein substantially all of the electroplating solution is recovered and returned to an electroplating tank.

An even further object of the instant invention is to provide an effective apparatus for rinsing electroplating solution from the surfaces of an article, wherein the overall cost of the apparatus is minimized and wherein the apparatus occupies a minimal amount of floor space.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 1:
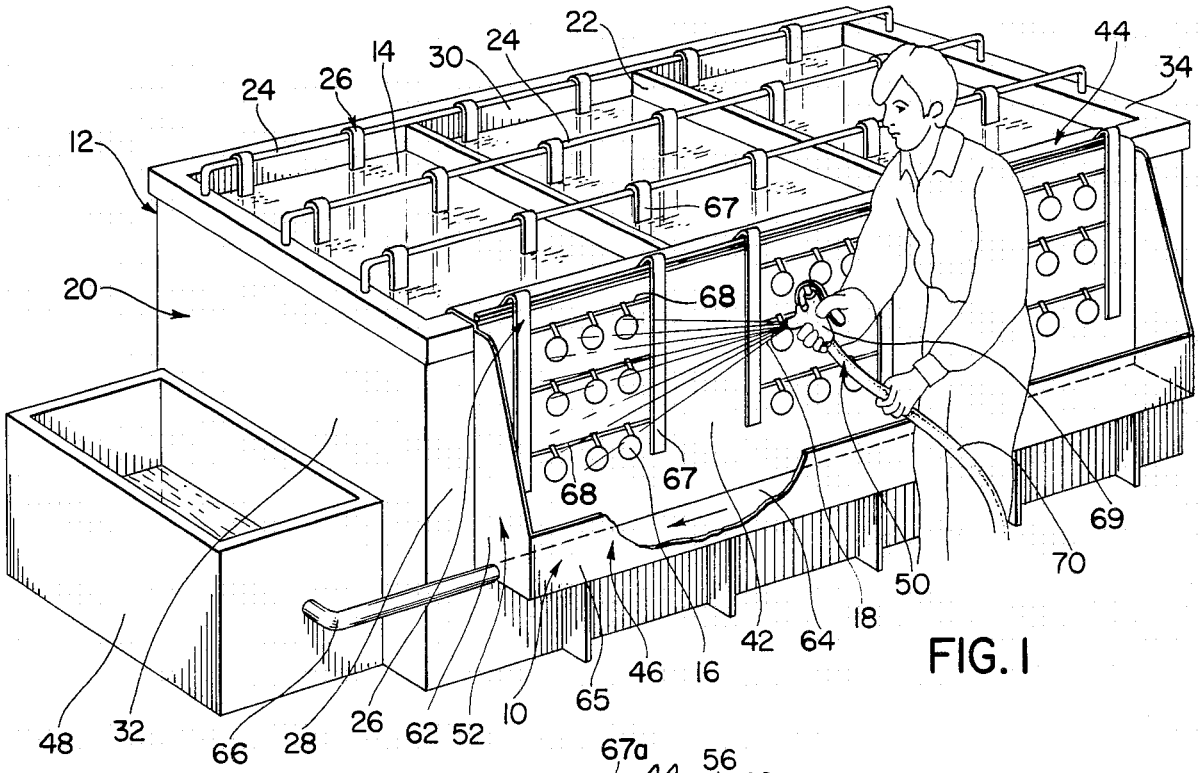
FIG. 1 is a perspective view illustrating the method of the instant invention as it is carried out utilizing the apparatus of the instant invention.
Figure 2:
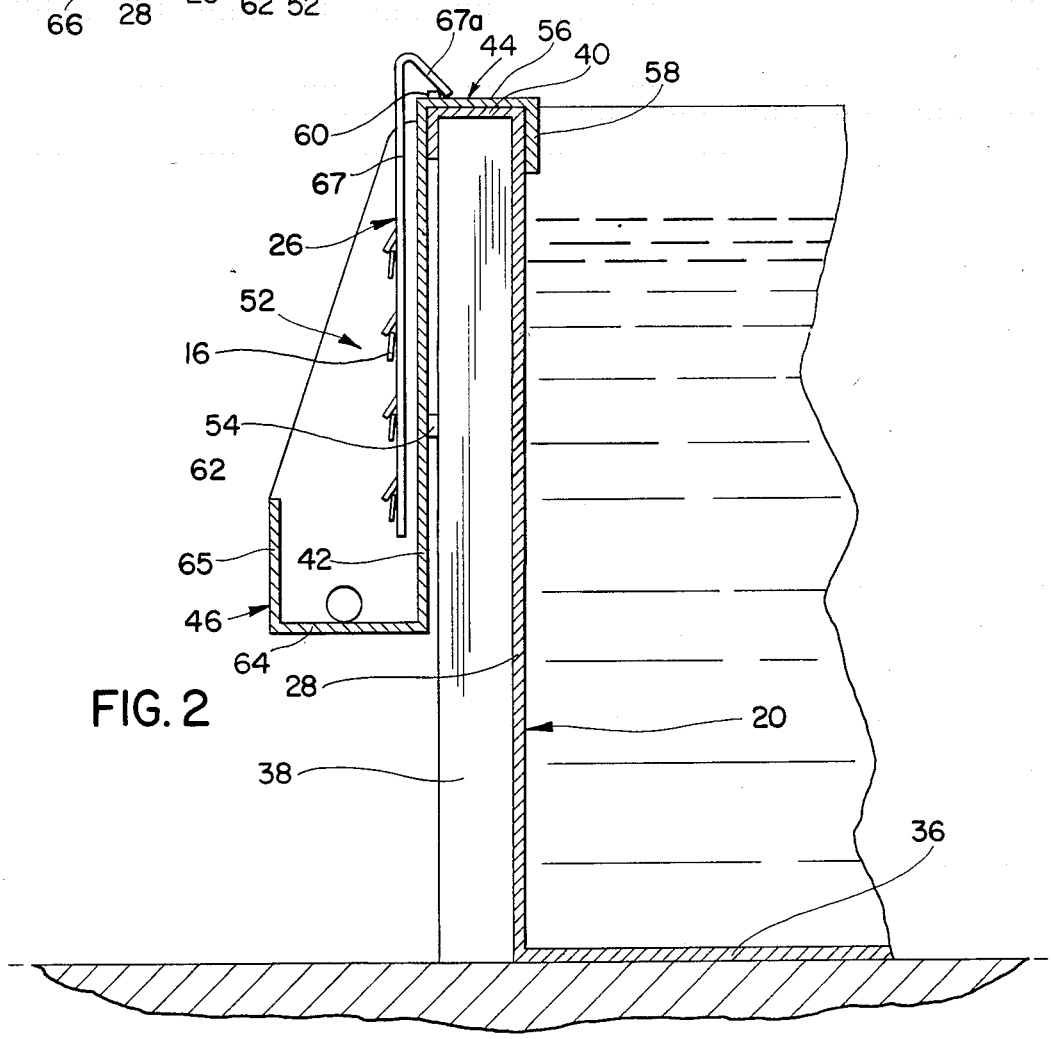
FIG. 2 is an enlarged sectional view of the apparatus illustrated in FIG. 1.

Referring now to the drawing, the apparatus of the instant invention is illustrated in FIGS. 1 and 2 and generally indicated at 10. The apparatus 10 is operative in combination with an electroplating tank generally indicated at 12 for rinsing electroplating solution 14 from the surfaces of articles 16 after the articles 16 have been plated in the tank 12. More specifically, after the articles 16 have been plated in the tank 12, they are removed therefrom and placed in the apparatus 10, and a rinse solution 18, such as water, is sprayed onto the articles 16 to remove any electroplating solution 14 carried from the tank 12 on the surfaces of the articles 16.

The tank 12 is preferably a conventional electroplating tank comprising a substantially rectangular container portion 20 having a plurality of partitions 22 therein and a plurality of support rods 24 which are electrically connected to one electrode of a DC power source, the other electrode of the power source being electrically connected to the solution 14. A plurality of metallic racks 26 to which the articles 16 are attached are suspended from the support rods 24 so that the racks 26 and the articles 16 are also electrically connected to the DC power source through the the hanger members 24 and so that the articles 16 are immersed in the solution 14. The container portion 20 is prefereably of substantially rectangular configuration and comprises substantially rectangular front and rear walls 28 and 30, respectively, a pair of end walls 32 and 34, and a bottom wall 36. A plurality of stiffeners 38 are provided on the outer sides of the walls 28, 30, 32 and 34, and an upper rim 40 extends outwardly from the upper extremities of the walls 28, 30, 32 and 34 and then downwardly a short distance along the adjacent stiffeners 38.

The apparatus 10 comprises a splash wall 42, a hanger member generally indicated at 44, a trough generally indicated at 46, at least one of the racks 26, a holding tank 48 and a sprayer 50.

The splash wall 42, the hanger member 44, and the trough 46 are preferably formed from a suitable rigid and durable plastic material so that they cooperate to define an open housing-like structure 52 which is receivable on the wall 28 of the container portion 20 with the splash wall 42 positioned in a substantially vertical disposition adjacent the outer edges of the stifferners 38 on the wall 28. The splash wall 42 comprises a generally rectangular, substantially flat wall and has a spacer member 54 which extends in a substantially horizontal disposition across the rear surface thereof. The hanger member 44 is attached to the upper end of the splash wall 42 and comprises a rearwardly extending first flange 56 and a second flange 58 which extends downwardly from the rear end of the flange 56. The hanger member 44 is dimensioned to be received on the rim 40 in the manner illustrated in FIG. 2 for supporting the structure 52 on the wall 28. An elongated raised hanger rib 60 extends along the upper surface of the flange 56 adjacent the upper end of the splash wall 42. The trough 46 is defined by a pair of spaced end walls 62 which extend outwardly from the opposite ends of the splash wall 42, a bottom wall 64 which extends outwardly from the lower end of the splash wall 42 between the end walls 62 and a front wall 65 which extends upwardly from the forward end of the bottom wall 64 between the end walls 62.

The trough 46 is interconnected at one end thereof to the holding tank 48 through a tubular member 66 for draining liquid from the trough 46 into the holding tank 48. The holding tank 48 comprises a rectangular container which is preferably also constructed of a suitable durable plastic material.

The racks 26 are preferably conventional electroplating racks which are constructed of a suitable conductive metal, and preferably each comprises a pair of spaced vertical members 67 having flanges **67*a* which extend angularly downwardly from the upper ends thereof and a plurality of cross members 68 which extend between the vertical members 67. The racks are receivable on the hanger members 24 so that they are electrically connected to an appropriate electrode of a DC power source, and the articles 16 are supported on the cross members 68 so that they are electrically connected to the power source through the racks 26 and the hanger members 24**.

The sprayer 50 comprises a conventional manually operated spray nozzle 69 which is attached to a conventional hose 70 for supplying the rinse solution 18 which preferably comprises water to the nozzle 69, it being understood, however, that the use of automated sprayer apparatus is also contemplated. Preferably the nozzle 69 is operative for producing a relatively fine spray of rinse solution 18 so that the force of the spray does not dislodge the articles 16 from the racks 26.

For use and operation of the apparatus 10, the structure 52 is suspended from a wall such as the wall 28 of the container 20, and the holding tank 48 is preferably positioned adjacent an end of the container 20, such as the end 32. The structure 52 is preferably positioned on the wall 28 so that the bottom wall 64 of the trough 46 is inclined downwardly slightly toward the end thereof which is interconnected to the holding tank 48 through the tubular member 66 in order to promote the flow of liquid from the trough 46 into the tank 48. This may be accomplished by positioning a shim under the flange 56 at the end of the structure 52 which is remote from the tubular member 66, although other embodiments of the structure 52 which are constructed so that the bottom wall 64 is downwardly inclined by other means are also contemplated. In any event, after the apparatus 10 has been assembled adjacent the tank 12, a rack 26 is removed from the solution 14 and suspended from the flange 56 so that it is retained by the rib 60 and so that the articles 16 on the rack 26 are supported in the open housing-like structure 52 in front of the splash wall 42 above the trough 46. Thereafter, the apparatus 10 is utilized in accordance with the method of the instant invention for rinsing electroplating solution 14 from the articles 16.

While the preferred form of the method of the instant invention is carried out by utilizing the apparatus of the instant invention, it will be understood that other forms of the method of the instant invention which are carried out utilizing other types of apparatus are also contemplated. Broadly, the method of the instant invention for rinsing electroplating solution from the surfaces of articles comprises the steps of spraying the articles with a rinse solution to remove the plating solution therefrom and collecting the rinse solution sprayed onto the articles and any plating solution intermixed therewith. Preferably, thereafter, the collected rinse and plating solutions are transferred to the plating tank, and preferably the solution which is utilized for rinsing the articles comprises water. In the preferred form of the method in which the apparatus 10 is utilized, a rack 26 having one or more articles 16 thereon is removed from the plating solution 14 after the articles 16 thereon have been plated to the desired extent, and the rack 26 is suspended from the flange 56 of the hanger member 44 with the flange 67*a* of the rack 26 received behind the rib 60 so that the rack 26 is retained on the hanger member 44 and so that the articles 16 are supported in the structure 52 in front of the splash wall 42 above the trough 46. The sprayer 50 is then utilized to spray rinse solution 18 onto the articles 16 in order to remove any plating solution 14 carried from the tank 12 on the surfaces of the articles 16. As a result of the inherently random characteristics of any sprayer such as the sprayer 50, the rinse solution 18 is simultaneously sprayed onto the splash wall 42 and the rack 26 as it is sprayed onto the articles 16. However, then the liquid comprising the rinse solution 18 and any plating solution intermixed therewith gravitates downwardly from the wall 42, the articles 16 and the rack 26, and the liquid is collected in the trough 46. The liquid collected in the trough 46 then flows through the tubular member 66 into the holding tank 48, and when a sufficient quantity of liquid is collected in the holding tank 48, it is preferably returned to the plating tank 12 by any convenient suitable means. In this regard, in most cases only relatively small quantities of rinse solution 18 are required to rinse the plating solution 14 from the articles 16 and hence liquid is not collected at a rapid rate in the holding tank 48. Accordingly, since a certain amount of evaporation normally take place from any plating tank and since small quantities of plating solution 14 are normally removed from the tank 12 with the articles 16, substantially all of the liquid which is accumulated in the holding tank 48 can normally be accommodated in the plating tank 12, and hence substantially complete recovery of the plating solution 14 is achieved by this process.

It is seen therefore that the apparatus and method of the instant invention provide effective solutions to the problem of rinsing electroplating solutions from the surfaces of articles subsequent to the plating of the articles. The method of the instant invention can normally be carried out utilizing only minimal quantities of rinse solution 18, such as water, and substantially all of the rinse solution is recovered. Furthr, substantially all of the plating solution 14 which is carried on the surfaces of the articles 16 when they are removed from the tank 12 is also recovered. As a result, the need for disposing of effluents containing high quantities of plating solutions into sewage systems is eliminated. The apparatus of the instant invention provides an effective apparatus for carrying out the method of the instant invention, and it also substantially reduces the manufacturing costs for a plating solution system since it eliminates the need for rinse tanks. Further, the apparatus can be accommodated in a substantially smaller area of floor space than conventional electroplating solution system apparatus. Accordingly, for these reasons as well as the other reasons hereinabove set forth it is seen that the method and apparatus of the instant invention represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for rinsing electroplating solution from articles subsequent to the plating thereof comprising:

a. a splash wall having an upper edge and having an outwardly facing surface thereon;

b. means for supporting at least one of said articles in front of said splash wall surface;

c. an upwardly facing elongated trough attached to the lower end of said splash wall and extending longitudinally therealong and outwardly beneath said splash wall surface and beneath said article support means for receiving rinse solution and electroplating solution intermixed therewith when said article is supported on said article support means and said rinse solution is sprayed onto said article, said trough having an outer wall with an upper edge which is substantially beneath the upper edge of said splash wall;

d. means extending rearwardly from said splash wall for suspending said splash wall, said article support means and said trough from an upper edge of a wall of an electroplating tank so that said splash wall is disposed adjacent the outer surface of said tank wall and so that said trough is longitudinally inclined downwardly toward a lower end thereof; and e. means communicating with said lower trough end for draining said rinse solution with electroplating solution intermixed therewith from said trough and for collecting same.

2. An electroplating solution system for plating and rinsing articles comprising:

a. an electroplating tank containing an electroplating solution for plating said articles; and b. a rinsing apparatus received and secured on a wall of said electroplating tank for rinsing said articles subsequent to the plating thereof, said rinsing apparatus comprising;

i. a splash wall having an upper edge and having an outwardly facing surface thereon;

ii. means for supporting at least one of said articles in front of said splash wall surface;

iii. an upwardly facing elongated trough attached to the lower end of said splash wall and extending longitudinally therealong and outwardly beneath said splash wall surface and beneath said article support means for receiving rinse solution and electroplating solution intermixed therewith when said article is supported on said article support means and said rinse solution is sprayed onto said article, said trough having an outer wall with an upper edge which is substantially beneath the upper edge of said splash wall;

iv. means extending rearwardly from said splash wall for suspending said splash wall, said article support means and said trough from an upper edge of a wall of said electroplating tank so that said splash wall is disposed adjacent the outer surface of said tank wall and so that said trough is longitudinally inclined downwardly toward a lower end thereof; and v. means communicating with said lower trough end for draining said rinse solution with electroplating solution intermixed therewith from said trough and for collecting same.

3. The apparatus of claim 1 further comprising means for spraying a rinse solution onto said articles to rinse electroplating solution therefrom.

4. The apparatus of claim 2 further comprising manually operable spray hose means for spraying a rinse solution onto said article on said article support means for rinsing electroplating solution therefrom.

* * * * *